US005941771A

United States Patent [19]

Haste, III

[11] Patent Number: 5,941,771

[45] **Date of Patent: *Aug. 24, 1999**

[54] ELECTRONIC GAMING MACHINE AND METHOD

[76] Inventor: Thomas E. Haste, III, 11288 Ventura Blvd., #734, Studio City, Calif. 91604

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/784,475

[22] Filed: Jan. 17, 1997

Related U.S. Application Data

[63] Continuation-in-part of application No. 08/552,221, Nov. 2, 1995, Pat. No. 5,595,538, which is a continuation-in-part of application No. 08/406,024, Mar. 17, 1995, Pat. No. 5,580, 311.

[51] Int. Cl.[6] ..... A63F 9/24

[52] U.S. Cl. ..... 463/17; 463/25; 273/139

[58] Field of Search ..... 463/1, 16–18, 463/20, 29; 273/138 R, 139; 364/412, 410; 283/49, 70, 901, 903; 235/375; 221/1, 2, 24

[56] References Cited

U.S. PATENT DOCUMENTS

| | | | |
|---|---|---|---|
| 4,677,553 | 6/1987 | Roberts et al. | 463/17 |
| 4,689,742 | 8/1987 | Troy et al. | 463/18 |
| 4,725,079 | 2/1988 | Koza et al. | 273/139 |
| 4,774,571 | 9/1988 | Mehdipour et al. . | |
| 4,832,341 | 5/1989 | Muller et al. . | |
| 4,842,278 | 6/1989 | Markowicz . | |
| 4,953,895 | 9/1990 | Goussios | 273/139 |
| 4,982,337 | 1/1991 | Burr et al. | 273/139 |
| 5,039,848 | 8/1991 | Stoken . | |
| 5,088,737 | 2/1992 | Frank et al. | 463/18 |
| 5,222,624 | 6/1993 | Burr . | |
| 5,317,135 | 5/1994 | Finocchio | 364/412 |
| 5,348,299 | 9/1994 | Clapper | 463/16 |
| 5,377,975 | 1/1995 | Clapper | 463/17 |
| 5,407,199 | 4/1995 | Gumina . | |
| 5,407,200 | 4/1995 | Zalabak . | |
| 5,411,260 | 5/1995 | Smith . | |
| 5,451,052 | 9/1995 | Behm et al. . | |
| 5,487,544 | 1/1996 | Clapper, Jr. | 273/139 |
| 5,499,816 | 3/1996 | Levy | 273/139 |
| 5,507,491 | 4/1996 | Gatto et al. | 273/139 |
| 5,580,311 | 12/1996 | Haste, III | 463/16 |
| 5,595,538 | 1/1997 | Haste, III | 463/17 |

*Primary Examiner*—Jessica J. Harrison
*Assistant Examiner*—Mark Sager
*Attorney, Agent, or Firm*—Blakely, Sokoloff, Taylor & Zafman LLP

[57] ABSTRACT

A gaming machine prints and dispenses game tickets. Ticket substrates are imprinted with game indicia in accordance with game sequence information stored in an electronic memory module. The ticket substrates may be intrinsically valuable articles such as telephone calling cards.

9 Claims, 8 Drawing Sheets

ELECTRONIC GAMING MACHINE AND METHOD

RELATED APPLICATIONS

This application is a continuation-in-part of U.S. patent application Ser. No. 08/552,221, filed Nov. 2, 1995, now U.S. Pat. No. 5,595,538 which is a continuation-in-part of U.S. Patent application Ser. No. 08/406,024, filed Mar. 17, 1995, now U.S. Pat. No. 5,580,311.

BACKGROUND OF THE INVENTION

This invention relates generally to electronic gaming apparatus and, more particularly, to an apparatus that prints and dispenses game tickets, which may be in combination with articles having intrinsic value.

A wide variety of electronic gaming devices are known in the art. One particular example of such an electronic gaming device dispenses "pull-tab" game tickets. A conventional pull-tab game is played in gaming establishments using a large number of cards or game tickets, which are dealt from a box upon payment of purchase price. Each game ticket bears a number of symbols or indicia, covered by a removable tab or a coating that can be scratched off. Some of the cards bear winning combinations of indicia, and these may be presented by the purchasers to redeem prizes.

Various attempts have been made to mechanize the pull-tab game, such that it can be played using an automated coupon dispensing machine. For example, U.S. Pat. No. 5,348,299 issued to Ronald C. Clapper, Jr. discloses and claims a machine of this general type.

A desirable attribute of such machines is that they should outwardly resemble gaming machines of the type known as "slot machines," "slots," or "one-armed bandits." In using these conventional slot machines, a player deposits a coin or token and activates the machine, either by pulling a lever, in the case of an electromechanical machine, or simply pressing a button, in the case of a fully electronic machine. The machine presents the player with a matrix of symbols or indicia, which change rapidly for a few seconds after activation, and then presents a final display, which may contain a winning combination. The winning combination usually requires the horizontal or other alignment of symbols of the same type. When this happens, the machine "pays off" by automatically dispensing prize money in the form of coins, or by activating a winner light or audible signal. These gaming machines are, of course, extremely popular in casinos and other gaming establishments. However, in some jurisdictions, machines of this type are illegal, although pull-tab games are not. Therefore, there has been a movement toward pull-tab machines that have an appearance similar to the more popular slot machines. The machine disclosed in the Clapper, Jr. Patent presents an electronic three-by-three matrix display of symbols similar to those used in conventional slot machines. However, the matrix display is not randomly generated when the machine is activated. Instead, the display is generated to duplicate the pattern on a pull-tab coupon that is dispensed from the machine each time it is played. The coupons in the Clapper, Jr. system are dispensed from a large roll of coupons stored inside the machine. The roll contains duplicate strips, one of which is retained in the machine for subsequent auditing purposes, and other of which is cut into dispensed coupons. On the back of one of the strips is a machine readable bar code indicating which symbols or indicia are on each coupon. Before the coupon is distributed to the player, the bar code is read by an optical scanner and the same symbols that appear on the coupon are displayed on the matrix display of the machine. Thus, the machine retains some of the allure of a conventional slot machine, but still qualifies as a pull-tab game under regulations governing the use of gaming machines.

Pull-tab games are not legal in all jurisdictions. Even in jurisdictions where pull-tab gaming machines are not permitted, certain games of chance may be allowed if the player receives an item of value for the amount that may otherwise be considered a wager. Thus, a pull-tab gaming ticket may be provided to a patron in conjunction with an item that is purchased, even if the patron's true motivation for making the purchase is to receive the gaming ticket.

SUMMARY OF THE INVENTION

The present invention resides in an electronic gaming machine and a method for its use. Briefly, and in general terms, the gaming machine of the invention comprises a payment acceptance device for receiving payment from a customer wishing to use the gaming machine; a supply of ticket substrates installed in the gaming machine; and a ticket dispenser for dispensing game tickets one at a time from the supply of tickets. The gaming machine further comprises an electronic memory module which stores game sequence information. As a game ticket is dispensed, a printer in the gaming machine prints game indicia on the ticket substrate in accordance with the game sequence information retrieved from the electronic memory module.

The ticket substrates may be blank ticket stock or may comprise articles having intrinsic value, such as telephone calling cards.

The gaming machine may also include a display device for displaying game indicia to the customer. Such game indicia may emulate any of a variety of games of chance, including, but not limited to indicia that are displayed in conventional slot machines. The indicia printed on the dispensed ticket may be the same as that displayed to the customer or may simply notify the customer whether the ticket is a "winner" or a "loser".

The invention may also be defined as a method of conducting a game of chance comprising the steps of providing an electronic gaming machine having a supply of ticket substrates and an electronic memory module storing game sequence information; accepting payment from a customer wishing to use the machine; printing game indicia on a next ticket substrate from the supply of ticket substrates in accordance with game sequence information retrieved from the electronic memory module; and dispensing the printed ticket substrate to the customer.

It will be appreciated from the foregoing that the present invention represents a significant advance in the field of gaming machines. In particular, the invention provides a high level of security because the game indicia are neither imprinted nor encoded on the ticket substrates in any manner until the ticket is printed and dispensed to the customer. Prior to dispensing the ticket, all game sequence information is secured in the electronic memory module. Other aspects and advantages of the invention will become apparent from the following more detailed description, taken in conjunction with the accompanying drawings.

DETAILED DESCRIPTION OF THE INVENTION

Figure 1:
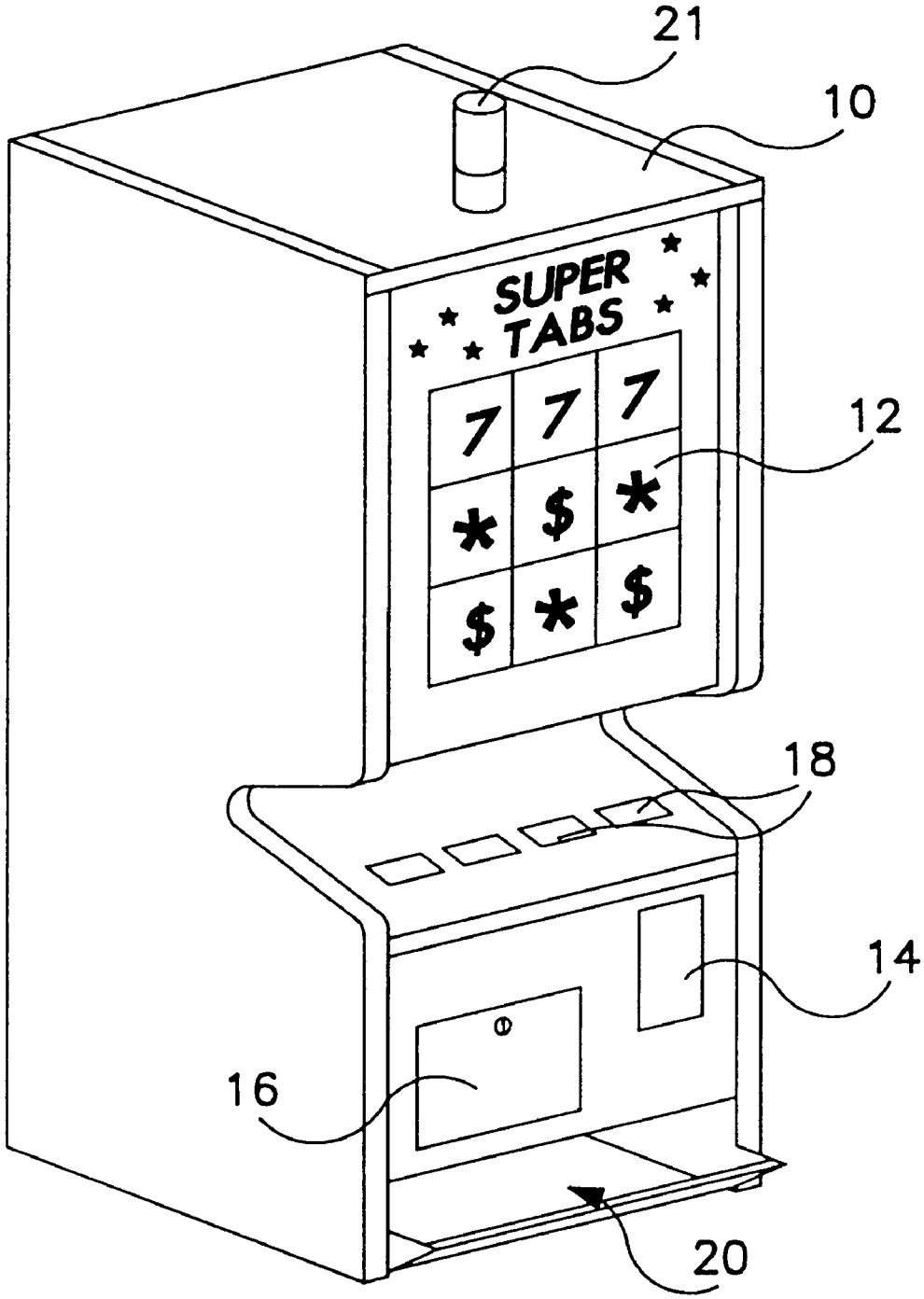
FIG. 1 is simplified perspective view of a pull-tab gaming machine in accordance with the present invention.

As shown in the drawings for purposes of illustration, the present invent pertains to a gaming machine. One example of such a machine is the "pull-tab" type, which dispenses game tickets having a removable cover or coating. Upon removal of the ticket cover or coating, imprinted symbols or indicia on the ticket are revealed to a purchaser of the ticket. Only a small number of preselected tickets bear a winning combination of symbols.

In machines of this type that have previously been proposed, there is little to prevent an unscrupulous owner or operator of such a machine from scanning a roll of game tickets prior to installing it in a machine for public use, and thereby determining the locations of winning tickets on the roll. In accordance with the present invention, a pull-tab gaming machine is provided with security features that preclude an owner or operator of the machine from locating the winning tickets. In machines of the prior art, each ticket included a bar-coded form of the indicia. The ticket was scanned by a bar-code scanner and the information obtained was used to display the indicia on a video display device. In the subject invention, the indicia on each ticket are not encoded on the ticket, so the winning tickets cannot be identified by scanning the tickets. Moreover, because the indicia are printed under a cover strip on each ticket, winning tickets cannot be identified by simply viewing the ticket roll.

More specifically, FIG. 1 shows a gaming machine in which the subject invention may be installed. The machine includes a sturdy housing, indicated by reference numeral 10, preferably of steel or similar material, a video display 12 for displaying "reel" information, analogous to the way electromechanical slot machines display rotatable reels on which symbols or indicia are imprinted. The video display 12 is also used to display player credits and other information. The machine also includes a cash or bill acceptor 14, a cash box 16 and a set of play buttons 18. At the bottom of the machine is a ticket dispenser tray 20, and on top of the machine is winner light 21, which alerts players and others that a winning ticket has been purchased.

Figure 2:
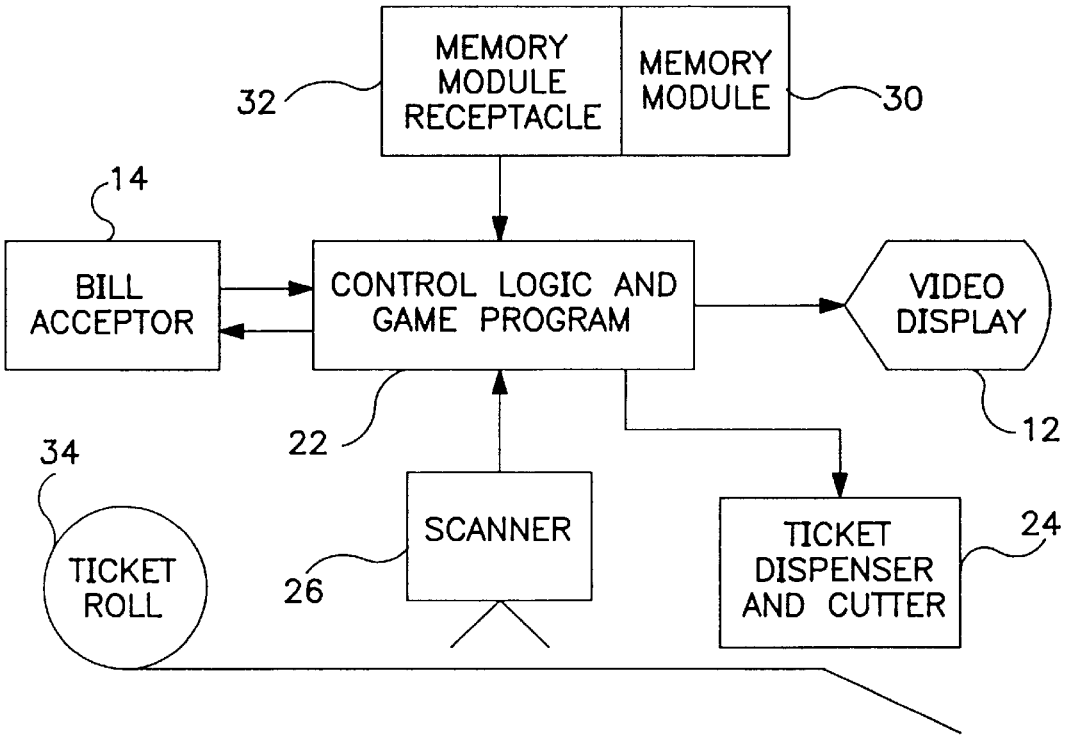
FIG. 2 is a block diagram depicting the principal components of the gaming machine of the invention.

FIG. 2 shows the principal components of the gaming machine of the invention. Control logic and a gaming program 22 control operation of the machine in a relatively straightforward manner, as will be further described below. The logic 22 controls the video display 12 and the bill acceptor 14, as well as a ticket dispenser and cutter 24 and a ticket scanner 26. An additional feature of the subject invention is an electronic memory module 30, which plugs into a memory module receptacle 32, which in turn is electrically connected to the control logic 22.

The memory module 30 contains a record of data for each game ticket on a roll of tickets 34. Each ticket record contains the following data: (1) an encoded form of the ticket indicia printed on the ticket, (2) a ticket number identifying the sequential position of the ticket, (3) a roll number identifying a specific ticket roll 34, and (4) a deal number identifying a ticket "deal." A deal is a database of winning and losing tickets. Depending on local legislation covering operation of the machine, a deal could encompass a single roll or multiple rolls of tickets. Various gaming regulation schemes require there to be a certain number of winning tickets in a deal of specified size. The memory module 30 in the presently preferred embodiment of the invention is a flash memory that is both programmable and non-volatile, i.e. the contents of the memory are preserved even when electrical power is not supplied to the module. The module is preferably highly tamper-proof. Any attempt to read, copy or modify the contents of the module renders it inoperative for purposes of the gaming machine.

Unlike electronic pull-tab machines of the prior art, the machine of the subject invention is not solely controlled by the indicia encoded onto the game tickets. The only information encoded on each ticket is its identifying data, including the ticket number, roll number and deal number. It will be understood, of course, that other forms of ticket identifying data could be used for purposes of the subject invention. When a new ticket is purchased, the identifying data is scanned into the control logic and the next ticket record in sequence is read from the memory module 30. The ticket data is then compared with corresponding information obtained from the memory module 30. If the ticket number, roll number and deal number read from the ticket are the same as the corresponding numbers read from the memory module 30, the ticket is deemed to be valid and is dispensed from the machine. The corresponding ticket record in the memory module 30 is then erased, to preclude the possibility of tampering by reading the memory module a second time. At about the same time that the ticket is dispensed, the indicia information retrieved from the memory module 30 is displayed in the video display 12 for the convenience of the game player. The player can then view the contents of the ticket without having to remove the cover from the purchased ticket.

The game logic also determines whether the ticket contains a winning combination of indicia. This win-lose result may be also stored in the memory module 30, or the game logic may determine from internally stored game rules whether the combination of indicia is a winning one or not. In the case of a winning ticket, the game logic 22 may activate the winner light 21 on the machine to alert the player or an attendant that a winning ticket has been purchased.

Figure 3:
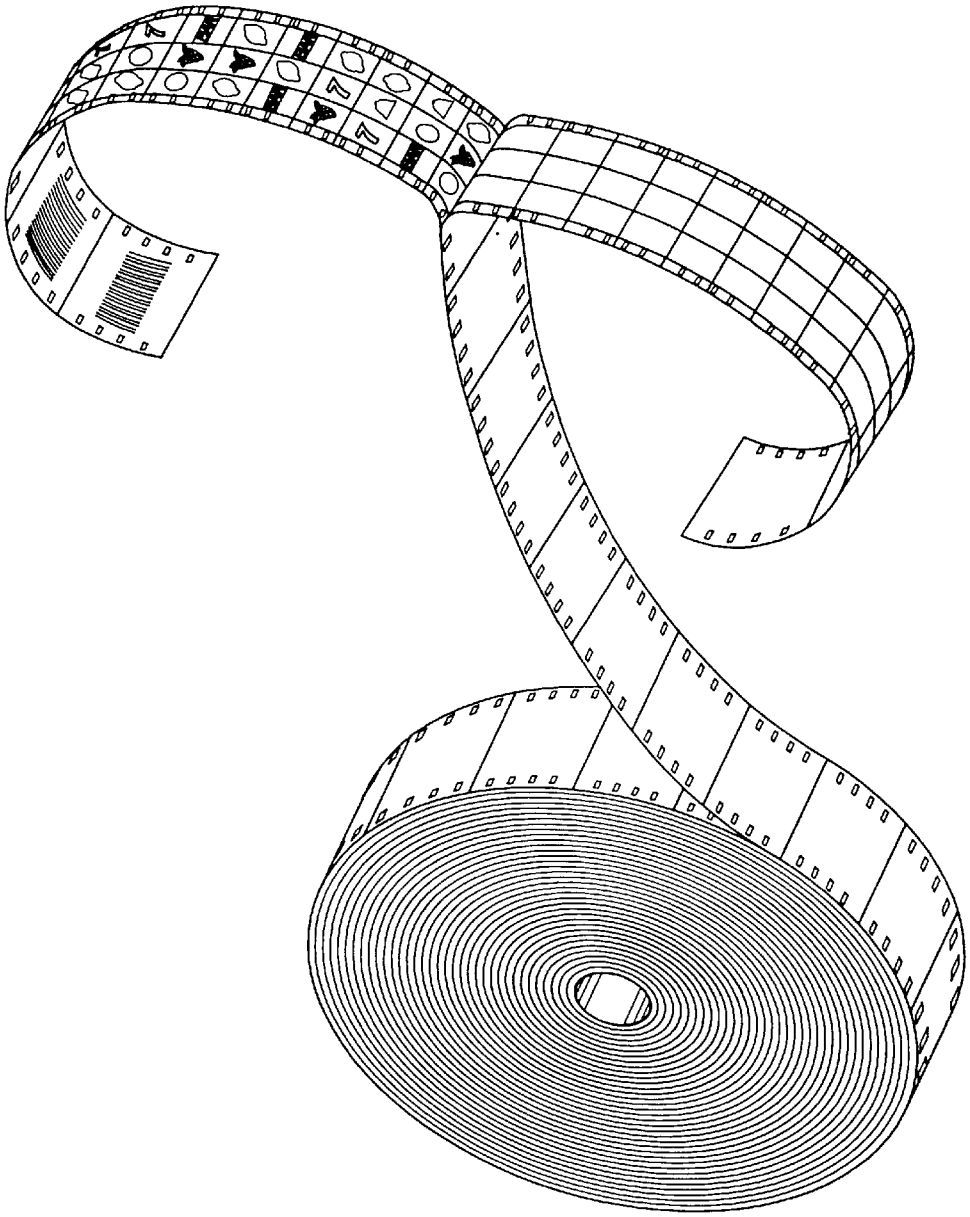
FIG. 3 is a perspective view of a roll of game tickets.

As shown in FIG. 3, each roll 34 of tickets is imprinted with indicia or symbols used in the game. Typically each ticket contains nine such indicia and a winning combination requires the alignment of two or three similar or related indicia in a single horizontal, vertical or, in some cases, diagonal row. As illustrated, each ticket includes a cover strip that renders the indicia invisible prior to removal of the cover strip. The cover strip may take the form of an adhesive film removable by simply peeling it off, an opaque coating removable by scratching, or other forms of opaque covering.

Figure 5A:
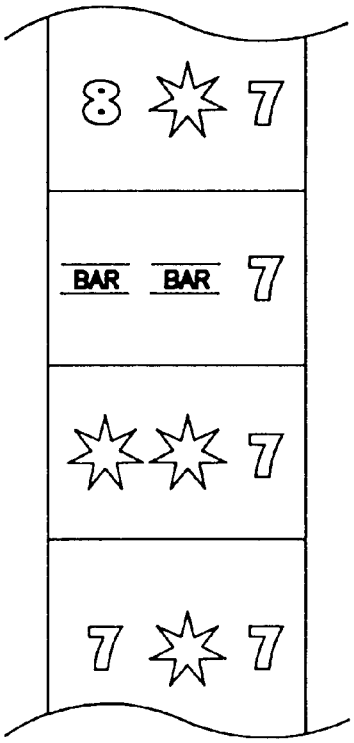
FIG. 5*a* and 5*b* are front and rear views of a portion of a roll of a first type of game tickets used in the gaming machine of the invention.
Figure 5B:
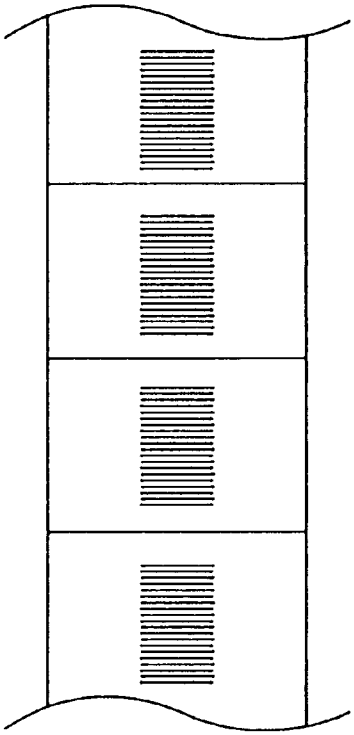

As also shown in FIG. 5, each ticket on the roll 34 also has imprinted bar codes on an exterior surface of the ticket, such that the bar codes can be scanned without removing the cover strip from the ticket. As mentioned earlier, the bar codes contain no information concerning the indicia imprinted on the ticket, but only ticket number, roll number and deal number information. For additional security, the bar codes are preferably encrypted in some manner to prevent even this information from being easily obtained by someone without knowledge of the type of encryption used. Even if the bar codes were read by an unauthorized person, they would be of no use in determining the location of winning tickets on the roll 34.

Figure 4:
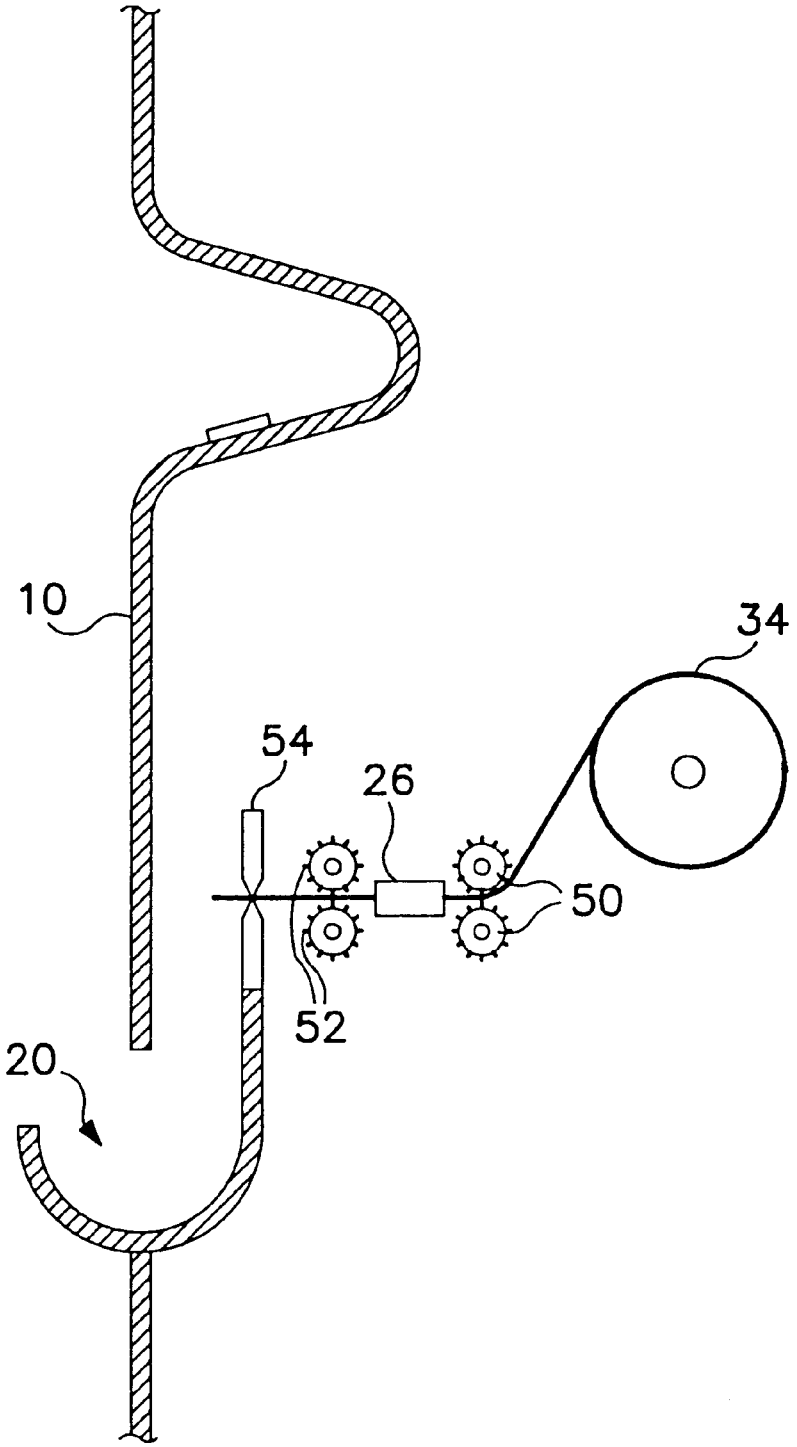
FIG. 4 is fragmentary elevation view, partly in section, showing ticket dispensing and scanning components of the gaming machine.

FIG. 4 shows the tape dispensing mechanism in more detail, including two pairs of feeder wheels 50 and 52 arranged on each side of the scanner 26, a ticket cutter 54, shown in relation to the housing 10 and the tab dispenser tray 20.

Figure 6:
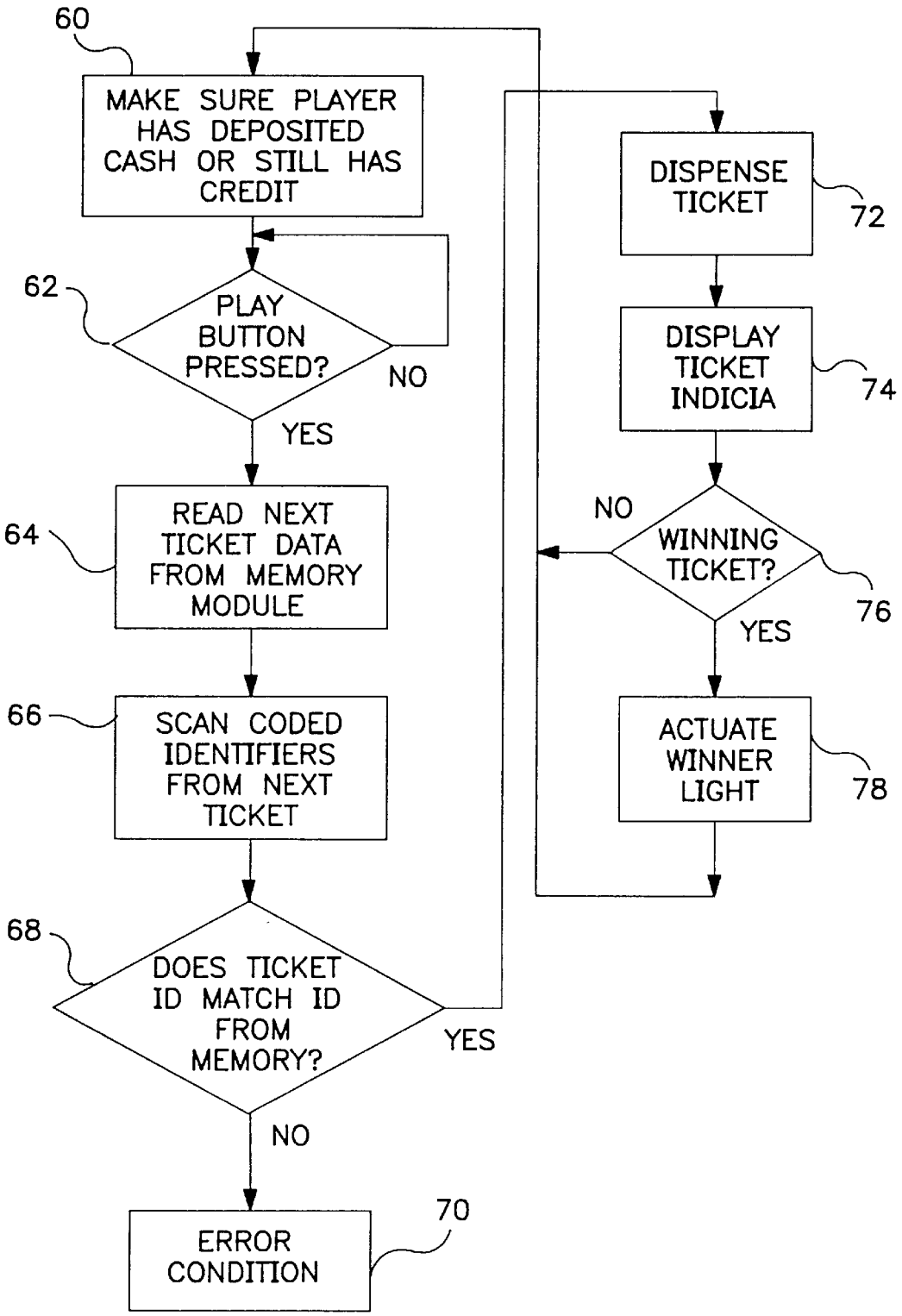
FIG. 6 is a flowchart showing the principal functions performed by the control logic of FIG. 2.

The principal functions performed by the control logic 22 (FIG. 2) are shown in the flowchart of FIG. 6. When the gaming machine is waiting to be activated, its principal function is to check for deposit of a coin or bill into the machine, as indicated in block 60. Once a deposit has been made, or credit remains from a prior play of the machine, the logic checks repeatedly for actuation of a "play" button on the machine, as indicated in decision block 62. Once a play has been initiated, the logic initiates reading of the next ticket image from the memory module 30, as indicated in block 64, and scans the coded ticket identifying data from the next ticket in the roll 34, as indicated in block 66. Then the ticket identifier from the memory module is compared with the identifier scanned from the ticket itself, as indicated in decision block 68. If the identifiers do not match, an error condition exists, as indicated in block 70, and operation of the machine would normally be terminated.

If the identifying data on the ticket matches the data retrieved from the memory module 30, the control logic 22 dispenses the ticket, as indicated in block 72, displays the indicia derived from the electronic ticket record, as indicated in block 74 and determines whether the ticket is a winning one, as indicated in decision block 76. If a winning ticket is indicated, the winner light is activated, as indicated in block 78, and other action may be taken before returning to block 60 and waiting for the next play to be initiated.

Figure 7:
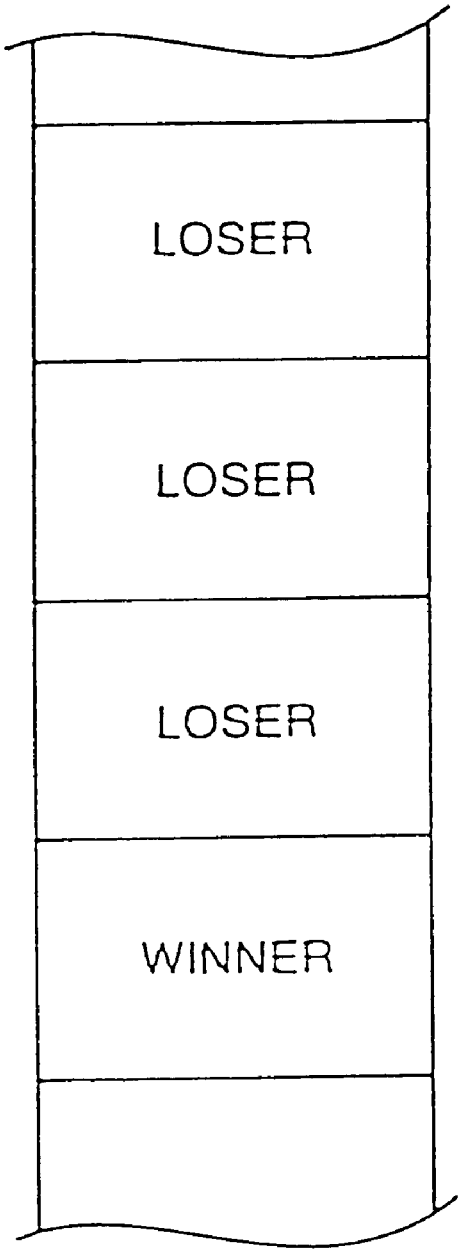
FIG. 7 is a front view of a portion of a roll of a second type of game tickets used in the gaming machine of the invention.

In another embodiment of the invention, each ticket as shown in FIG. 7 is imprinted with indicia that indicates whether the related stored indicia are a winning or losing combination, rather than the related indicia in the ticket record. The indicia may be, for example, statements such as "LOSER" or "WINNER" or the indicia may be dollar amounts, or other symbols. The ticket is also encoded with a ticket identifier. Upon activation, the subject invention reads each record of ticket indicia from the memory module 30. The control logic 22 dispenses the ticket, as indicated in block 72, and displays the indicia derived from the electronic ticket record, as indicated in block 74.

The gaming machine may include a means for inserting the ticket after it has been dispensed which includes a ticket reader 25. The ticket reader 25 reads the encoded ticket identifier and obtains the related stored indicia. The information is then processed to display the related indicia.

It will be appreciated from the foregoing that the subject invention represents a significant advance in the field of gaming machines. In particular, the invention provides an electronic gaming machine with security features that effectively preclude unauthorized detection of winning tickets in a roll of tickets dispensed from the machine and simplifies the operating costs and procedures of such machines.

In particular, although each ticket is scanned in the machine as it is dispensed, and the indicia related to the ticket are displayed on a display device, it is impossible to determine which indicia are related to the ticket without scanning the information from the memory module or game controller. The indicia are not encoded on the ticket at all, but encoded instead in the memory module, which is accessed whenever a play is initiated and a ticket record is read. Ticket identifying data are scanned on the ticket and the displayed indicia are derived from the memory module rather than from information encoded on the ticket. Since the roll of tickets cannot be scanned to determine locations of winning tickets, the gaming machine has a high level of security, but still operates in somewhat the same manner as a conventional slot machine.

It will also be appreciated that the simplified tickets, which will indicate either winner or loser but not include the specific indicia, significantly reduce the printing costs of the tickets, and thus the costs for operating the machines. Moreover, in many instances, an operator of the gaming machines will only need to replace the software which drives the modules, rather than ticket rolls as well, since the ticket are not specific to a particular game.

Figure 8:
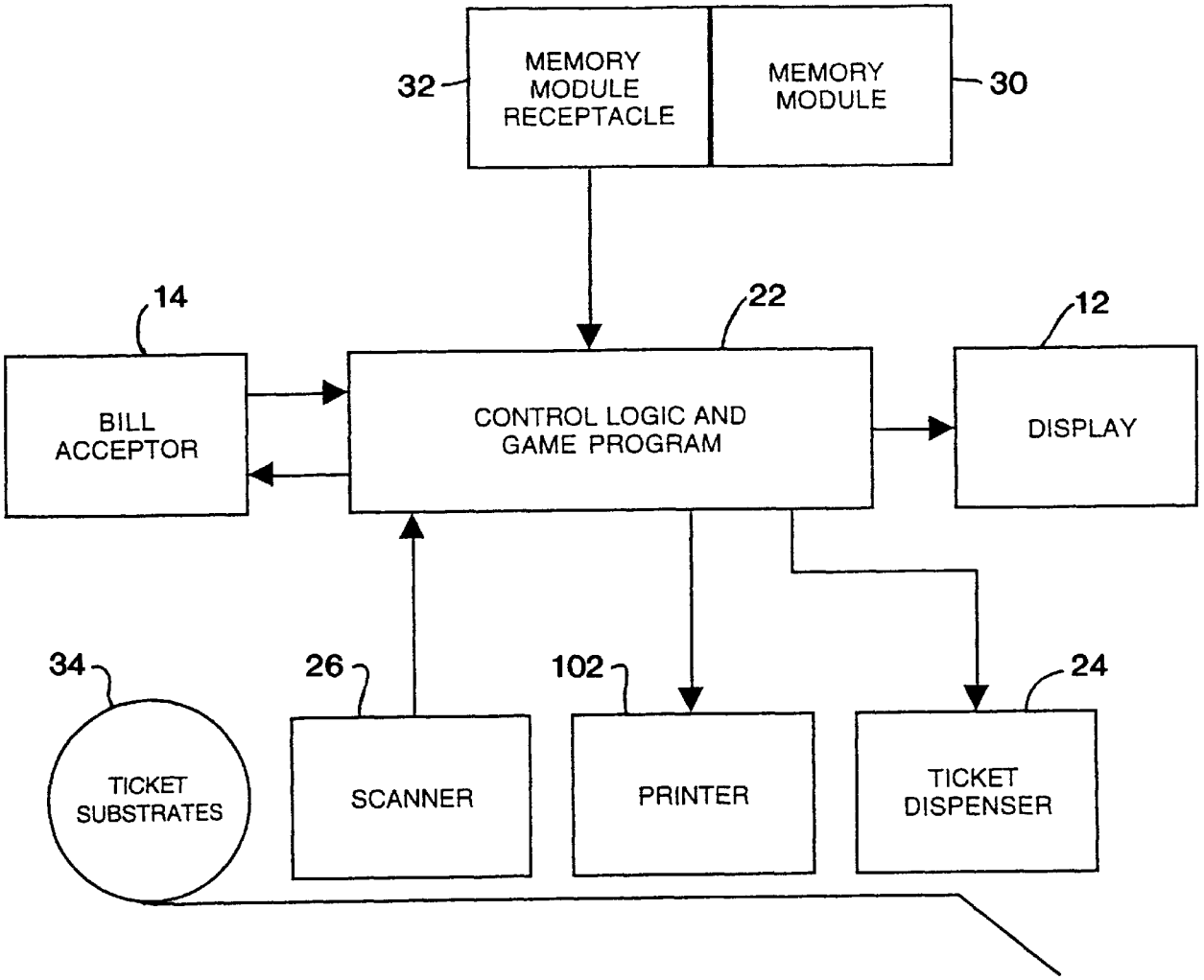
FIG. 8 is a block diagram of an alternative embodiment of the present invention.

Referring now to FIG. 8, an alternative embodiment of the present invention generally similar to that of FIG. 2 is shown. In this embodiment, game information in the form of game sequence information is stored entirely in electronic memory module 30. Such information is a virtual record of the tickets that will be dispensed by the machine. A supply of ticket substrates 34' is devoid of any indicia to indicate whether individual tickets are winners or losers. A printer 102 is coupled to control logic 22 to imprint ticket substrates with game indicia immediately before they are dispensed from ticket dispenser 24. Since the ticket substrates are not preprinted with game indicia, it is not necessary that the ticket substrates be encoded with identifying data, although this may still be done if desired. Such identifying data on each ticket, for example a bar code, may be desirable in order to validate winning tickets and thereby prevent blank ticket substrates from being fraudulently printed as winning tickets. In this regard, it will be recognized that there is always a one-to-one correspondence between the virtual ticket records stored in the electronic memory module and the physical tickets dispensed by the machine. Thus, only certain predetermined ticket substrates will be dispensed as winning tickets.

As in the previously described embodiments, printer 102 may imprint the ticket substrates with game indicia such as illustrated in FIG. 3 or simply with a win/lose indication as indicated in FIG. 7.

In jurisdictions that permit pull-tab gaming machines, the ticket substrates may be nothing more than blank ticket stock. However, where pull-tab gaming is not allowed, the present invention may be embodied in a machine that dispenses articles of value. In this case, the ticket substrates would have intrinsic value apart from the game of chance. For example, the ticket substrates may comprise prepaid telephone calling cards. Thus, a customer purchasing such a card would receive value for the purchase in the form of prepaid telephone service. The game of chance is incidental to the utility of the calling card, even though it may provide significant motivation for the purchase.

It will be appreciated that, although specific embodiments of the invention have been described in detail by way of example, various modifications may be made without departing from the spirit and scope of the invention, which should not be limited except as by the accompanying claims.

I claim:

1. An electronic gaming machine comprising:

a payment acceptance device for accepting payment from a customer;

a supply of ticket substrates installed inside the gaming machine;

an electronic memory module storing a plurality of sequential ticket records, each ticket record comprising a ticket number and data signifying whether the ticket record corresponds to a winning ticket or a losing ticket;

control electronics for retrieving a next ticket record from the electronic memory module;

a printer for printing game indicia on a next ticket substrate from the supply of ticket substrates, said indicia identifying the next ticket substrate as a winning ticket or a losing ticket in accordance with said next ticket record;

a ticket dispenser for dispensing the printed next ticket substrate to the customer;

wherein there is a one-to-one correspondence between sequential ticket substrates that are printed and dispensed by the gaming machine and the plurality of sequential ticket records.

2. The electronic gaming machine of claim 1 wherein at least some of the ticket substrates comprise articles having intrinsic value.

3. The electronic gaming machine of claim 1 wherein at least some of the ticket substrates are preprinted with indicia giving such substrates intrinsic value.

4. The electronic gaming machine of claim 1 wherein the ticket dispensed to the customer comprises a telephone calling card.

5. The electronic gaming machine of claim 1 further comprising a display device.

6. The electronic gaming machine of claim 5 wherein the display device displays game indicia in accordance with the next ticket record retrieved from the electronic memory module.

7. A method of conducting a game of chance comprising the steps of:

providing an electronic gaming machine having a supply of ticket substrates and an electronic memory module storing a plurality of sequential ticket records, each ticket record comprising a ticket number and data signifying whether the ticket record corresponds to a winning ticket or a losing ticket;

accepting payment from a customer;

retrieving a next ticket record from the electronic memory module;

printing game indicia on a next ticket substrate from the supply of ticket substrates, said indicia identifying the next ticket substrate as a winning ticket or a losing ticket in accordance with said next ticket record;

dispensing the printed next ticket substrate to the customer;

wherein there is a one-to-one correspondence between sequential ticket substrates that are printed and dispensed by the gaming machine and the plurality of sequential ticket records.

8. The method of claim 7 further comprising the step of displaying game indicia in accordance with the next ticket record retrieved from the electronic memory module.

9. The method of claim 7 wherein the game indicia printed on said next ticket substrate comprises a plurality of game symbols.

* * * * *